US005609119A

United States Patent [19]

Yeh

[11] Patent Number: 5,609,119

[45] Date of Patent: Mar. 11, 1997

[54] METHOD OF MAKING EMBROIDERY

[76] Inventor: Ching-Lin Yeh, 58, Ma Yuan West St., Taichung, Taiwan

[21] Appl. No.: 588,732

[22] Filed: Jan. 19, 1996

[51] Int. Cl.[6] ..... D05C 9/04; D06C 3/08

[52] U.S. Cl. ..... 112/475.23; 38/102.2; 112/103

[58] Field of Search ..... 112/403, 411, 112/439, 103, 475.18, 475.22, 425.23; 38/102.2, 102.31; 101/127.1

[56] References Cited

U.S. PATENT DOCUMENTS 14,399 11/1917 Stern ..... 112/403

4,092,451 5/1978 Semaker ..... 112/475.18 X 4,517,910 5/1985 Jalowsky ..... 112/439

*Primary Examiner*—Ismael Izaguirre

*Attorney, Agent, or Firm*—Peterson, Wicks, Nemer & Kamrath, P.A.

[57] ABSTRACT

A method of making a three-dimensional embroidery comprises the steps of framing the double-layered fabric and framing the thermal-decomposed fabric with at least two frames, placing the thermal-decomposed fabric on the double-layered fabric, embroidering the fabrics with embroidering threads, decomposing a brush-off fabric, and removing the frames to form a semi-product, spraying the pressurized air on the semi-product, and forming the product.

5 Claims, 4 Drawing Sheets

METHOD OF MAKING EMBROIDERY

BACKGROUND OF THE INVENTION

The invention relates to a method of making embroidery. More particularly, the invention relates to a method of making a three-dimensional embroidery.

The conventional embossed embroidery cannot make a three-dimensional embroidery nor display hollowed-out embroidery. In order to obtain a three-dimensional embroidery or display hollowed-out embroidery, another conventional embroidery applies pollutant solvents to dissolve coatings or sizes on the embroidery. The color of the embroidery will be easily faded, and the material of the embroidery may be damaged.

SUMMARY OF THE INVENTION

An object of the invention is to provide a thermal decomposition method for making a three-dimensional embroidery.

Another object of the invention is to provide a method of making a three-dimensional embroidery without using solvents.

Accordingly, a method of making a three-dimensional embroidery comprises the steps of framing the base fabric and framing the thermal-decomposed fabric with at least two frames, placing the thermal-decomposed fabric on the base fabric closely, embroidering the fabrics with embroidering threads, decomposing a brush-off fabric and removing the frames to form a semi-product, spraying the pressurized air on the semi-product, and forming the product. The step of embroidering is to embroider embroidery patterns directly on the framed thermal-decomposed fabric and the framed base fabric by thermosetting embroidering threads. The step of decomposing the thermal-decomposed fabric and removing the frames is to press an iron on the framed thermal-decomposed fabric and the framed base fabric at 170° C. to 190° C., preferabbly 180° C., for about 1 minute to decompose the thermal-decomposed fabric into charred pieces and to remove the frames from the embroidered fabrics to form a semi-product.

DETAILED DESCRIPTION OF THE INVENTION

Figure 1:
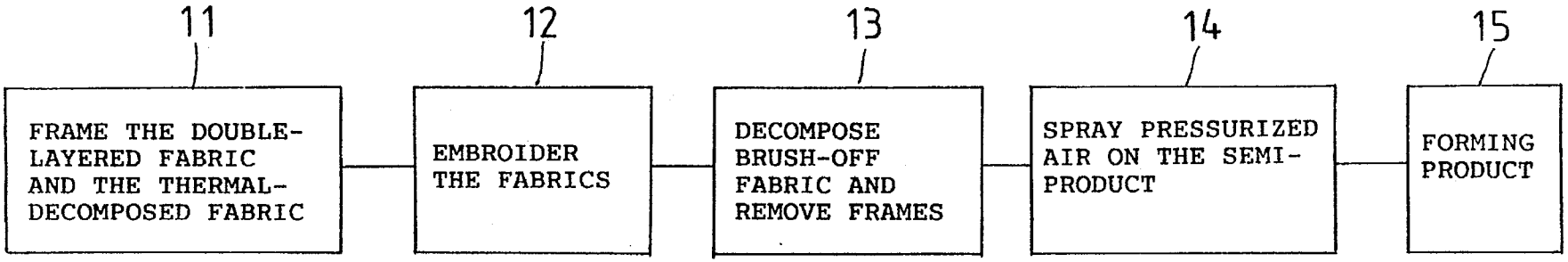
FIG. 1 is a flow diagram of making a three-dimensional embroidery in accordance with the invention.

Referring to FIG. 1, a method of making a three-dimensional embroidery comprises the steps of framing the double-layered fabric and the thermal-decomposed fabric 11, embroidering the fabrics 12, decomposing a brush-off fabric and removing the frames 13, spraying the pressurized air on the semi-product 14, and forming the product 15.

The step of framing the double-layered fabric and the thermal-decomposed fabric is represented by Step 11. Step 11 is described as follows.

Figure 3:
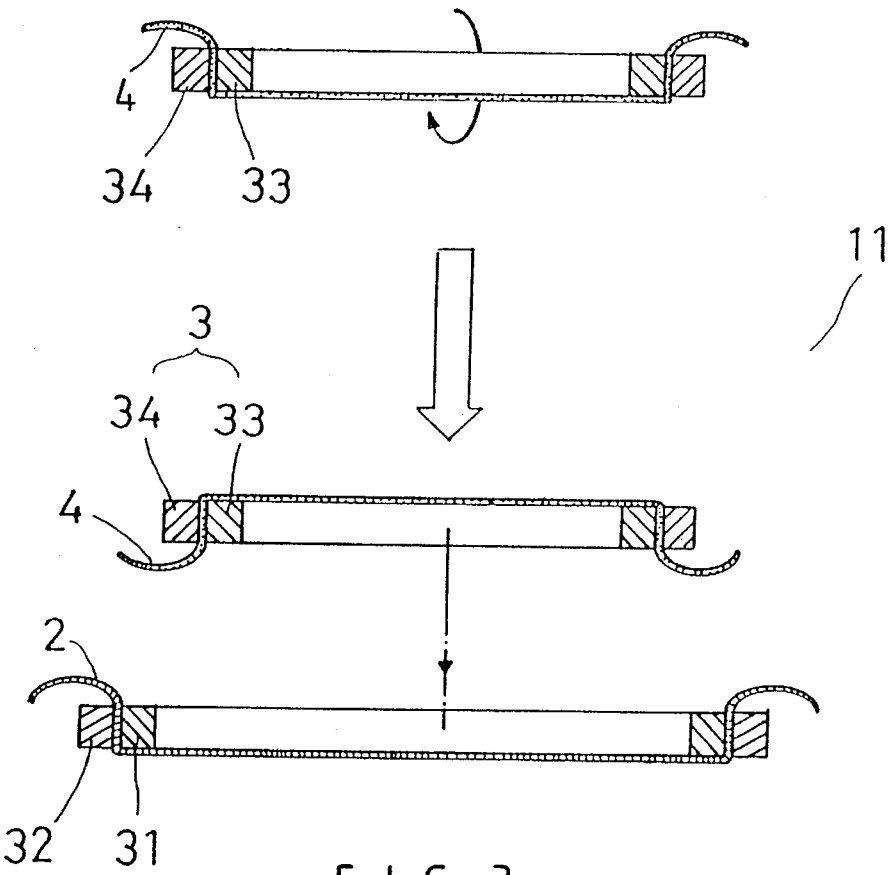
FIG. 3 is a schematic view illustrating a process of framing a fabric.
Figure 2:
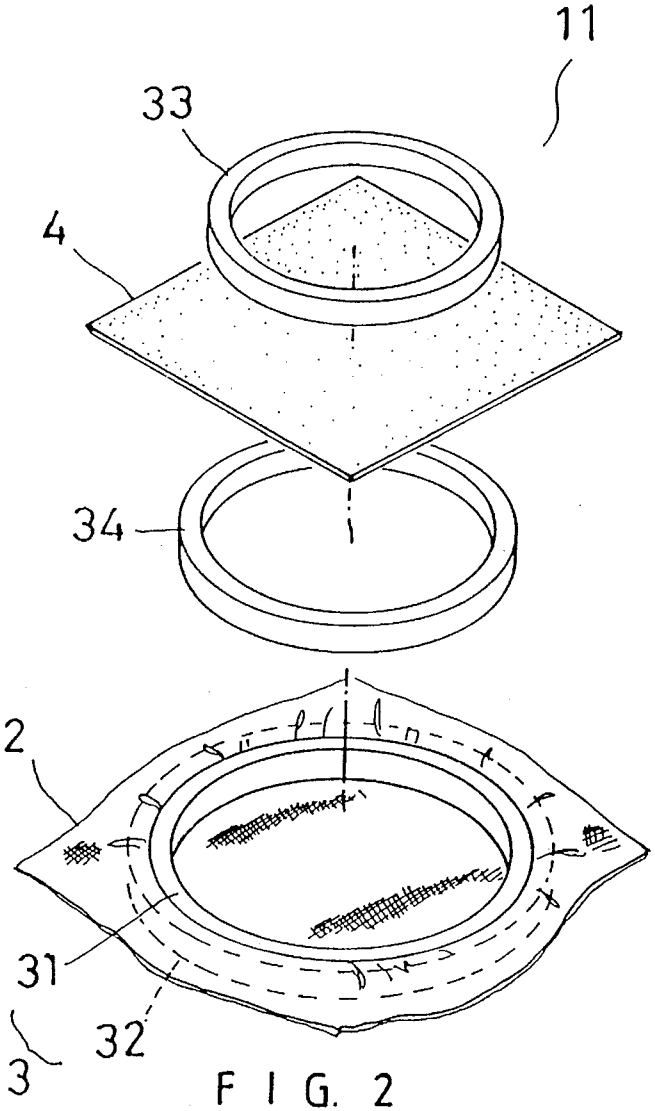
FIG. 2 is a perspective view of framing a fabric.
Figure 4:
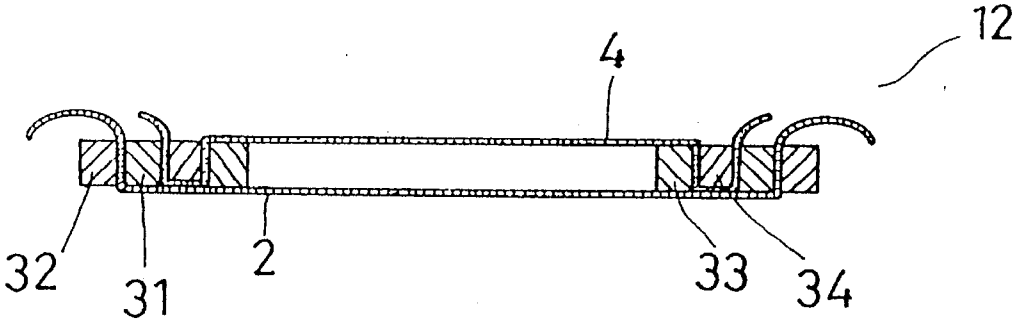
FIG. 4 is a cross-sectional view illustrating a framed fabric.

Referring to FIGS. 2 and 3, a frame assembly 3 has the first annular frame 31, the second annular frame 32, the third annular frame 33 and the fourth annular frame 34. The double-layered fabric 2 is framed between the first annular frame 31 and the second annular frame 32. The brush-off cellulosic thermal-decomposed fabric 4 is framed between the third annular frame 33 and the fourth annular frame 34. As shown in FIGS. 3 and 4, the framed thermal-decomposed fabric 4 is turned over to be inserted in the framed double-layered fabric 2. The distance between the framed thermal-decomposed fabric 4 and the framed double-layered fabric 2 can be adjusted by the thickness of the first annular frame 31, the second annular frame 32, the third annular frame 33 and the fourth annular frame 34.

Figure 5:
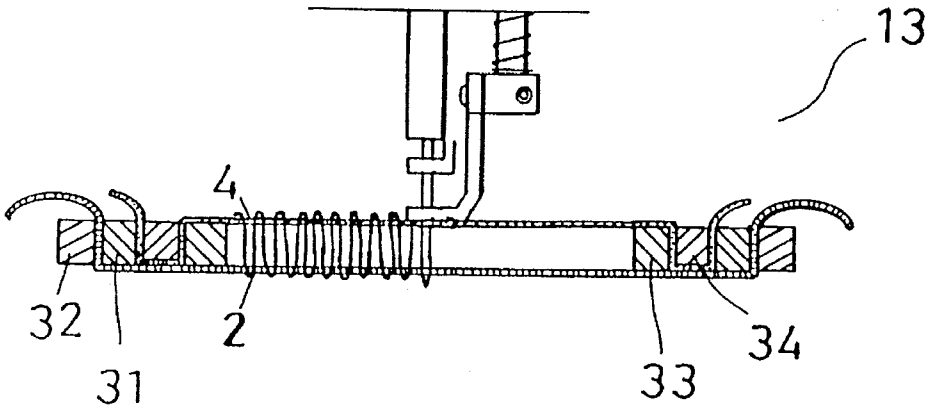
FIG. 5 is a schematic view illustrating a process of embroidering a fabric.
Figure 6:
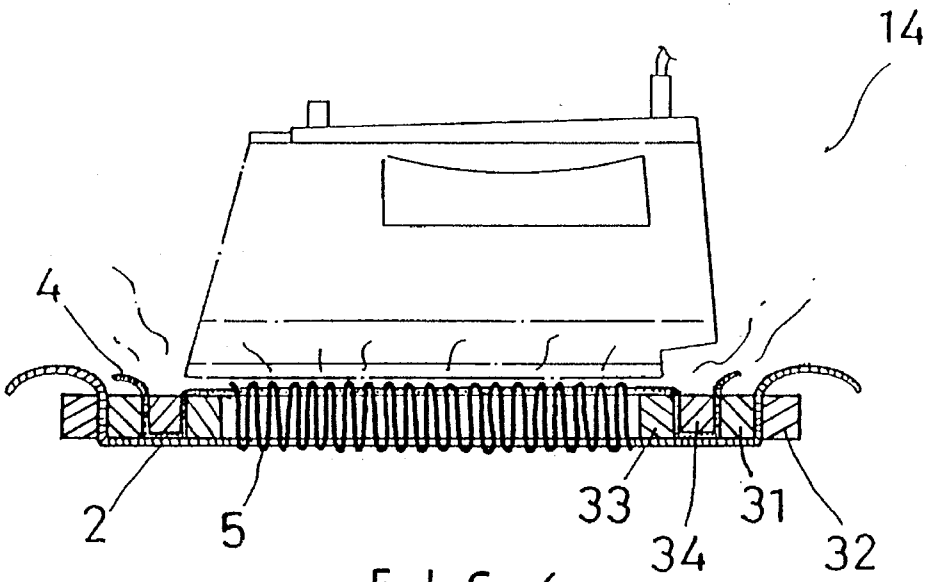
FIG. 6 is a schematic view illustrating a process of decomposing a brush-off fabric with an iron.

Step 12 is to embroider the framed fabrics 2 and 4. Referring to FIGS. 5 and 6, the embroidering threads 5 are made of thermosetting polyesters which can resist high temperatures. The embroidery patterns are directly formed on the framed thermal-decomposed fabric 4 and the framed double-layered fabric 2 by embroidering.

The step of decomposing the brush-off cellulosic thermal-decomposed fabric 4 and removing the frames 31, 32, 33 and 34 is represented by Step 13. Step 13 is described as follows in order to illustrate the step of the invention.

Referring to FIG. 6, an iron presses the framed thermal-decomposed fabric 4 and the framed double-layered fabric 2 at 170° C. to 190° C., preferably 180° C. for about 1 minute in order to decompose the brush-off cellulosic thermal-decomposed fabric 4 into charred pieces. Futher, the embroidering threads 5 are thermoset by the high temperatures. After the brush-off cellulosic thermal-decomposed fabric 4 is decomposed completely, the first annular frame 31, the second annular frame 32, the third annular frame 33 and the fourth annular frame 34 are removed from the embroidered fabrics to form a semi-product.

Step 14 is to spray the pressurized air on the semi-product. Step 14 is described as follows.

Figure 7:
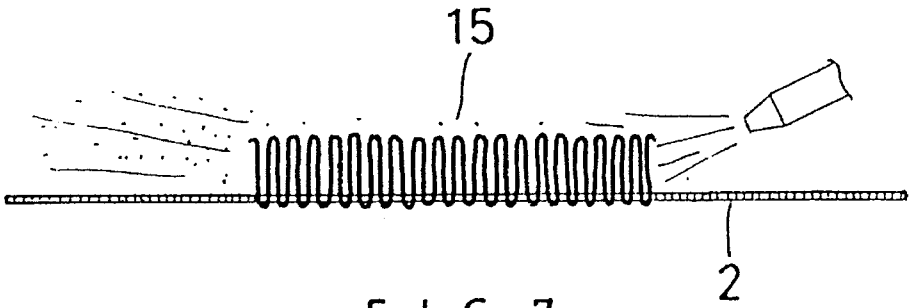
FIG. 7 is a schematic view illustrating a process of blowing an embroidered fabric with the pressurized air.

Referring to FIG. 7, the pressurized air is sprayed on the semi-product in order to remove the charred pieces from the embroidered fabrics.

The three-dimensional embroidery is formed after the semi-product is cleansed.

The variation of the preferred embodiment can be various. The fabric 2 may have multiple layers. The thermal-decomposed fabric 4 may have multiple layers also.

The invention is not limited to the above embodiment but various modification thereof may be made. It will be understood by those skilled in the art that various changes in form and detail may be made without departing from the scope of the invention.

I claim:

1. A method of making a three-dimensional embroidery comprising the steps of:

framing a base fabric and framing a thermal-decomposed fabric with at least two frames to form a framed base fabric and a framed thermal-decomposed fabric, respectively;

placing said framed thermal-decomposed fabric on said framed base fabric closely;

embroidering embroidery patterns directly on said framed thermal-decomposed fabric and said framed base fabric with thermosetting embroidering threads;

pressing an iron on said framed thermal-decomposed fabric and said framed base fabric at a temperature of about 170° C. to 190° C. for a period of about 1 minute to decompose said framed thermal-decomposed fabric into charred pieces;

removing said frames from said framed base fabric to form a semi-product; and spraying pressurized air on said semi-product to remove said charred pieces from said semi-product.

2. A method of making a three-dimensional embroidery as claimed in claim 1, wherein said base fabric is framed between a first frame and a second frame and said thermal-decomposed fabric is framed between a third frame and a fourth frame.

3. A method of making a three-dimensional embroidery as claimed in claim 1, wherein said embroidering threads are made of thermosetting polyesters.

4. A method of making a three-dimensional embroidery as claimed in claim 1, wherein said thermal-decomposed fabric is made of brush-off cellulosic materials.

5. A method of making a three-dimensional embroidery as claimed in claim 1, wherein said temperature is preferably 180° C.

* * * * *